United States Patent [19]

Matikainen

[11] Patent Number: 4,982,537

[45] Date of Patent: Jan. 8, 1991

[54] DEVICE FOR JOINING TWO BUILDING UNITS

[75] Inventor: Jukka Matikainen, Hämeenlinna, Finland

[73] Assignee: Oy Lohja AB, Virkkala, Finland

[21] Appl. No.: 435,368

[22] PCT Filed: May 4, 1988

[86] PCT No.: PCT/FI88/00069

§ 371 Date: Nov. 6, 1989

§ 102(e) Date: Nov. 6, 1989

[87] PCT Pub. No.: WO88/08904

PCT Pub. Date: Nov. 17, 1988

[30] Foreign Application Priority Data

May 6, 1987 [FI] Finland ..... 872001

[51] Int. Cl.[5] ..... E04B 1/21; E04B 1/24

[52] U.S. Cl. ..... 52/251; 52/252; 52/283; 52/583; 52/587

[58] Field of Search ..... 52/251, 583, 587, 252, 52/283

[56] References Cited

U.S. PATENT DOCUMENTS

| | | | |
|---|---|---|---|
| 691,169 | 1/1902 | Owen . | |
| 2,103,894 | 12/1937 | Bussmann | 52/583 |
| 2,442,184 | 5/1948 | Summers | 52/587 X |
| 3,513,610 | 5/1970 | Devonport | 52/587 X |
| 3,733,757 | 5/1973 | Scott | 52/583 |
| 3,952,468 | 4/1976 | Soum | 52/583 |
| 4,367,615 | 1/1983 | Feldman | 52/583 |

FOREIGN PATENT DOCUMENTS

| | | | |
|---|---|---|---|
| 2464340 | 1/1981 | France | 52/583 |

*Primary Examiner*—Henry E. Raduazo
*Assistant Examiner*—Deborah McGann Ripley
*Attorney, Agent, or Firm*—Fish & Richardson

[57] ABSTRACT

This invention relates to a device for joining two building units one of which is load-bearing and the other load-imposing. A conventional solution for joining e.g. a column and a beam is to form a sideward projection in the column for supporting the beam. This kind of projection complicates considerably the casting of the column and remarkable shearing forces are formed therein. In the invention these drawbacks are eliminated by fastening to the building units anchoring means which do not project from the column, at least not from the side surfaces thereof, and by positioning them in the building units in such a way that points at which the anchoring means extending from one building unit to the other are fastened to the building units are positioned in a completed joint at a distance from each other in the vertical direction.

7 Claims, 2 Drawing Sheets

Figure 5:
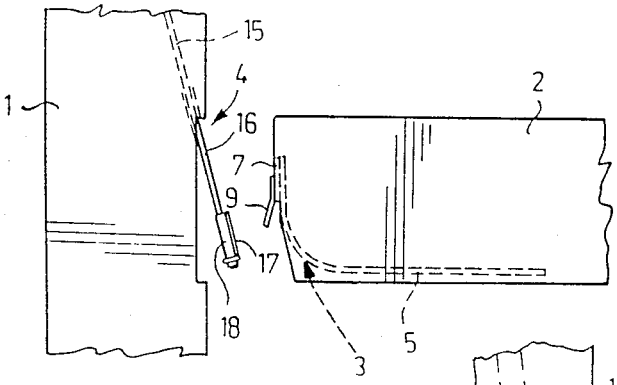

FIG. 1
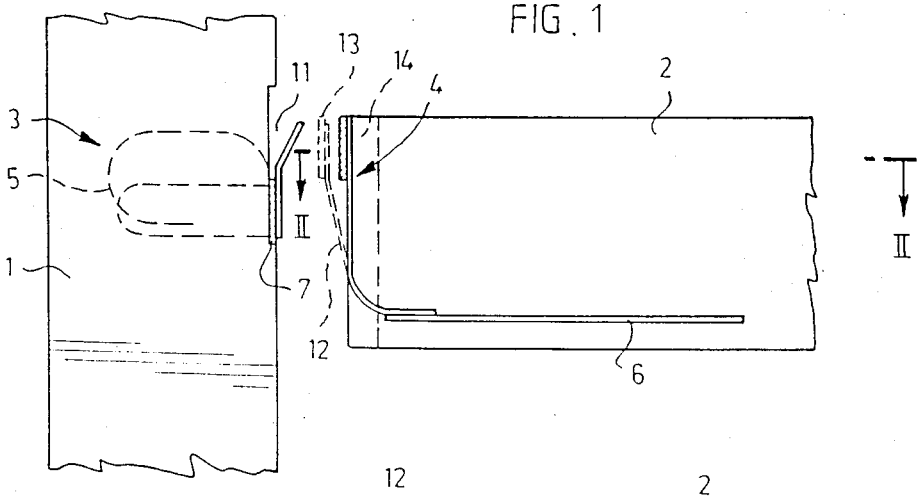
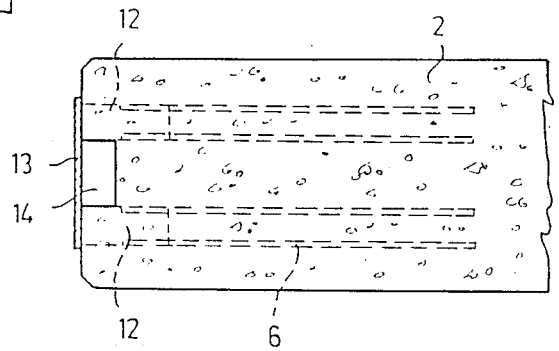
FIG. 2
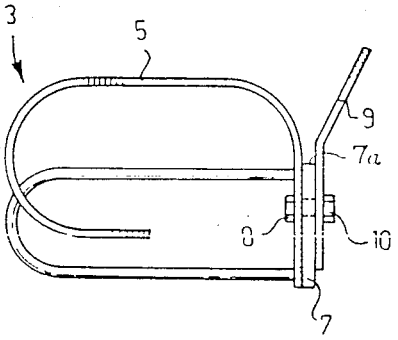
FIG. 3
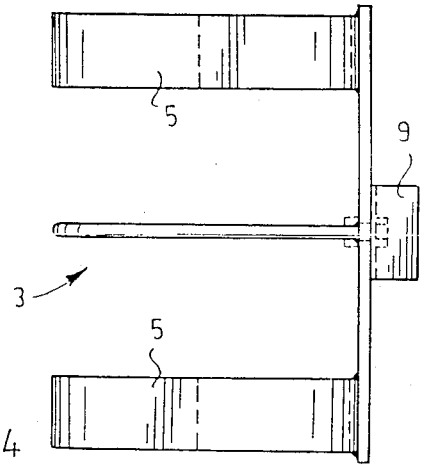
FIG. 4

DEVICE FOR JOINING TWO BUILDING UNITS

This invention relates to a device for joining two building units one of which is load-bearing and the other load-imposing.

Load-bearing and load-imposing building units, such as columns, beams, and walls, are traditionally joined by means of projections formed in a column for supporting beams and walls thereon. The projections may be integral with the column or they can be made of metal and fastened to a completed column.

The first-mentioned alternative complicates the casting of the column due to the complicated shape of the column and leads in expensive moulding works. On the other hand, it is difficult to fasten a separate projection to the column afterwards, and the result is unreliable. In both cases, it is necessary to dimension the projections taking into consideration the torque, shearing force, and normal force. It is also often necessary to diminish the effective height of the structure to a half. It is also to be noted that in certain cases some projections may break suddenly. A further drawback of these solutions is their unattractive appearance.

The object of the present invention is to provide a joint device for building units, which is easy to manufacture and the structural functionality of which can be ascertained by simple dimensioning conditions. By means of the joint it is possible to eliminate part of the drawbacks caused by constrained forces and to provide a structure which allows large tolerances and displacement without being damaged. Such properties are valuable also in various cases of accident and when constructing an energy-absorbing structure (against impact and vibration loads) A substantial part of the joint may also be formed by the soldered casting between the building units the operation of which depends on the kind and shape of the surfaces of the building units. The device according to the invention is characterized in that the device comprises anchoring means fastened to each building unit in connection with the casting, and a joining means fastened to a first anchoring means for forming a locking device for a second anchoring means, and that the fastening point of the second anchoring means in the building unit and said locking device are positioned in a completed joint at a distance from each other in the vertical direction.

The anchoring means do not complicate the casting of the building units because they can be positioned in such a way that they do not project from the building units during the casting process. Thus there are no projecting structural parts, whereby the parts are easier to manufacture industrially and easier to transport; furthermore, labour and building materials are saved. The flexibility of the anchoring means solves the tolerance problems possibly occurring.

As a result of the structure of the device according to the invention, the load-imposing building unit is in a way suspended from the load-bearing unit. Therefore, in place of torque or shearing forces there occurs mainly traction and/or compression in the joint. This kind of structure is also suited for use in seismic areas.

The advantages of the device according to the invention become particularly apparent when that portion of the second anchoring means which projects from the building unit is flexible. The second anchoring means may thereby consist of flat iron, steel wire rope, glass fibre rope, or the like.

The second anchoring means may be manufactured of one piece or two pieces to be joined only when the building units are interconnected.

At its simplest, the locking device intended for one anchoring means is effected in such a way that the joining means, the first anchoring means, and the building unit together define a pocket for the second anchoring means. The joining means is thereby preferably formed by a plate which is fastened to a supporting plate of the first anchoring means, the plate being positioned on the surface of the building unit in parallel therewith.

Figure 9:
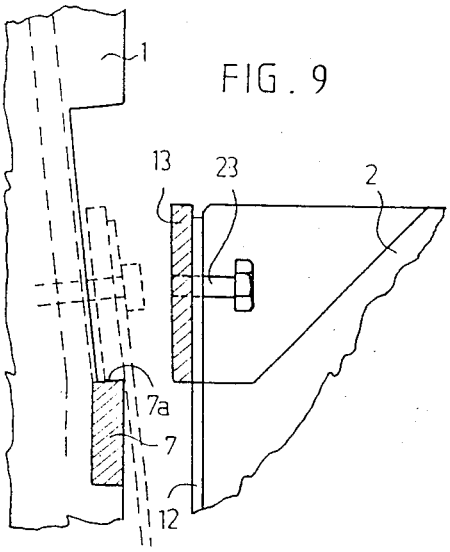
Figure 6:
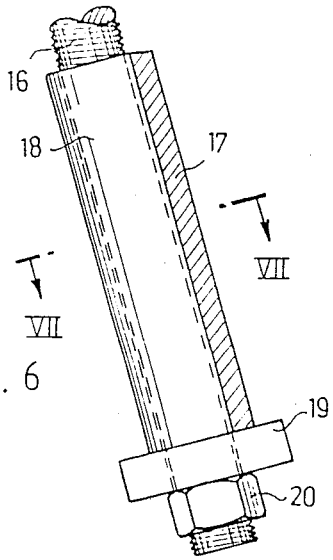
Figure 7:
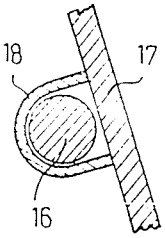

In the following the device according to the invention will be described in more detail with reference to the attached drawing, wherein FIG. 1 is a vertical sectional view of the device according to the invention, FIG. 2 is a horizontal sectional view of one building unit along the line II...II of FIG. 1, FIG. 3 is an enlarged side view of a first anchoring means, FIG. 4 is a top view of the first anchoring means, FIG. 5 illustrates another embodiment of the device according to the invention, FIG. 6 is an enlarged view of the free end of a second anchoring means, FIG. 7 is a section along the line VII...VII of FIG. 6, FIG. 8. is a general view of a third embodiment of the device according to the invention, and FIG. 9 is a side view of a fourth embodiment of the device according to the invention.

FIG. 1 illustrates two building units one of which is load-bearing, e.g. a column 1, and the other is load-imposing, e.g. a beam 2 or a wall.

For joining the building units, interlocking anchoring means are attached thereto in connection with the casting, a first anchoring means attached to the column being indicated with the reference numeral 3 and a second anchoring means attached to a beam with the reference numeral 4. Both anchoring means comprise grips 5 and 6, respectively, which are positioned within the building unit, and a visible part. As to the first anchoring means, said visible part is formed by a supporting plate 7 positioned on the surface of the building unit in parallel therewith. The plate 7 is positioned in a recess provided in the column surface, so that it is positioned inside the main plane of said side of the column. The upper edge surface of the supporting plate functions as a bearing surface *7a*. The supporting plate 7 comprises fastening means, such as a hole and a nut 8 for fastening a platelike joining means 9 to the outer surface of the supporting plate by means of a screw 10. The joining means 9 can also be fastened by welding or it is possible to provide behind the supporting plate 7 a member which is lockable by its own weight. Further, it is possible to shape the joining means 9 so that the locking operates by means of the total load exerted in the joint.

The joining means 9 is formed by a part parallel with the supporting plate and by an oblique part projecting upwards and outwards and defining with the upper edge of the supporting plate 7 and the bottom of the recess of the column a pocket 11 for the second anchoring means 4. The joining means may comprise oblique side surfaces for facilitating the mutual alignment of the building units.

That portion of the second anchoring means which projects from the end of the beam 2 is formed by two interspaced parallel arms 12 which are fastened e.g. by welding to the grips 6. The upper ends of the arms 12 are interconnected by means of a transverse plate 13, as a result of which the second anchoring means forms a loop outside the beam so that the plate 13 can be inserted in the pocket 11. In order that the joining plate 9 would have enough space between the plate 13 and the beam 2, a groove 14 is provided at the end of the beam. The arms 12 consist of flat iron flexible in the longitudinal direction of the beam 2.

The anchoring means are fastened to the building units 1, 2 in connection with the casting thereof. It appears from FIG. 1 that the first anchoring means 3 does not project from the side surface of the column, so that the column is considerably simpler to cast than if the column would comprise a sideward projection. The recess above the supporting plate 7 is formed by placing a detachable filler plate in the mould. After the casting of the column has been completed, the joining plate 9 is fastened to the supporting plate 7 as shown in FIG. 3.

The transverse plate 13 of the second anchoring means 4 projects from the beam, which, however, does not complicate the casting because said anchoring means is positioned at the end of the beam. In this case, too, filler plates are used during the casting, e.g. under the plate 13. A filler plate may also be positioned between the plate 13 and the beam in order to ensure that the plate 13 comes off the beam after the casting.

When joining the building units 1, 2, the transverse plate 13 is inserted in the pocket 11 of the column. As appears from FIG. 1, a point at which the second anchoring means 4 is fastened to the beam 2, i.e. a point at which it projects from the beam, and the locking plate 9 are positioned at a distance from each other in the vertical direction in a completed joint. In the embodiment of FIG. 1, the joining plate 9 is positioned above the fastening point of the second anchoring means, so that the beam is suspended from the column while the transverse plate 13 rests on the upper edge of the supporting plate 7.

FIGS. 5 to 7 show another embodiment of the device according to the invention. In principle, this embodiment is similar to that shown in FIGS. 1 to 4 except that it is turned upside down so that the first anchoring means 3 is positioned within the horizontal beam 2 and the second anchoring means within the column 1. In this case, the second anchoring means 4 is formed by two parts one of which is positioned within the column and the other outside the column. The part positioned within the column is formed by two parallel spiral sockets 15 and the external parts by two spiral rods 16 screwed into the sockets and a transverse plate 17 interconnecting said rods. The plate 17 is attached to the rods 16 by means of bushings 18, and a base plate 19 and a nut 20 are provided at the end of the rods.

In this embodiment, the anchoring means to be fastened to the column and the beam during the casting do not project outside the beam surfaces, not even at the end of the beam.

Figure 8:
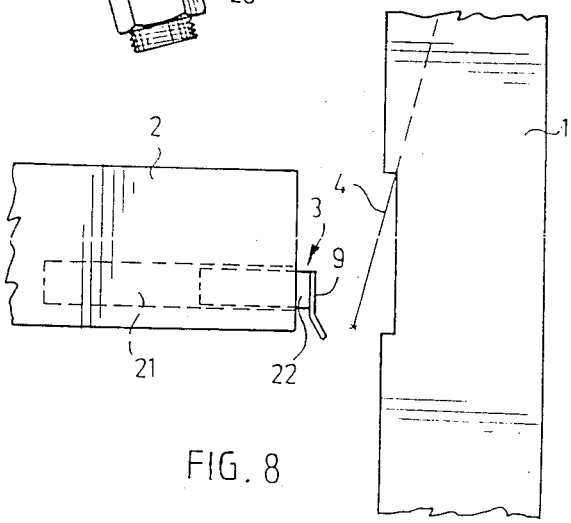

The embodiment of FIG. 8 corresponds to the solution of FIG. 5 with the exception of the structure of the first anchoring means 3. In this case, a recess 21 is provided at the end of the beam 2, into which recess a structure 22 comprising a joining plate 9 attached to the outer end thereof can be inserted.

The embodiment of FIG. 9 differs from the embodiment of FIG. 1 mainly in two respects. First the bearing surface *7a* of the supporting plate 7 deviates from the horizontal plane so that it is substantially perpendicular to the main direction of the arms 12 of the second anchoring means. The bearing surface *7a* may be arched as well (not shown). Second, the supporting plate does not comprise any joining means attached thereto; instead, the plate 13 of the second anchoring means 4 comprises a hole for a screw 23 by means of which the plate 13 can be fastened to a spiral bushing (not shown) positioned in the column.

In place of flat iron, the second anchoring means 4 may be formed by steel wire rope, fibre glass rope, or the like. It is essential in the invention that the anchoring means to be fastened to the building units in connection with the casting do not project from the side surface of the building units; on the other hand, as appears from FIG. 5, it is likewise possible to effect the invention in such a way that the anchoring means does not, either, project from the end face of the beam. The joint according to the invention withstands even major deformations, because the fastening points of the means 3, 4 in the building units are at different levels in the vertical direction and because the second anchoring means 4 extending from one fastening point to the other is flexible. Naturally, it is also possible to fasten the joining means 9 to the supporting plate 7 in some other way, and it can be integral with the first anchoring means 3 if it is shaped so that it is positioned inside the side wall of the column. The building units may be made of concrete or some other suitable material, such as steel.

I claim:

1. A device for joining two building units including a first anchoring means cast integrally with a first building unit and a second anchoring means cast integrally with a second building unit, said first anchoring means comprising: a supporting plate positioned on a surface of said first building unit in parallel therewith and having a bearing surface extending substantially perpendicular to said surface, said first anchoring means further having a plate-like joining means attached to said supporting plate and extending upward and outwardly from said bearing surface and forming a pocket adapted to receive said second anchoring means, said second anchoring means comprising: a loop formed by two spaced parallel arms having lower ends cast integrally with said second building unit and upper ends projecting from said second building unit and joined by means of a transverse plate and said loop adapted to receive said plate-like joining means with said transverse plate received in said pocket.

2. A device according to claim 1, characterized in that a portion of the second anchoring means which projects from the building unit is flexible.

3. A device according to claim 2, characterized in that the second anchoring means is formed from the group consisting of flat iron, steel wire rope, glass fibre rope.

4. A device as in any of the preceding claims, characterized in that the second anchoring means is positioned in a load-imposing building unit.

5. A device according to claim 2, characterized in that the second anchoring means is formed by a part positioned within the building unit and a projecting part attached thereto.

6. A device according to claim 1, characterized in that the bearing surface of the supporting plate is arched.

7. A device according to claim 1, characterized in that the joining means is formed by a screw attached to a plate of the anchoring means.

* * * * *